US010347397B2

(12) United States Patent
Armbrecht et al.

(10) Patent No.: US 10,347,397 B2
(45) Date of Patent: Jul. 9, 2019

(54) CABLE FOR TRANSMITTING ELECTRICAL SIGNALS

(71) Applicant: ROSENBERGER HOCHFREQUENZTECHNIK GMBH & CO. KG, Fridolfing (DE)

(72) Inventors: Gunnar Armbrecht, Mühldorf am Inn (DE); Thomas Schmid, Teisendorf (DE); Stephan Kunz, Chieming (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 16/084,478

(22) PCT Filed: Mar. 15, 2017

(86) PCT No.: PCT/EP2017/000339

§ 371 (c)(1),
(2) Date: Sep. 12, 2018

(87) PCT Pub. No.: WO2017/157521

PCT Pub. Date: Sep. 21, 2017

(65) Prior Publication Data

US 2019/0080823 A1 Mar. 14, 2019

(30) Foreign Application Priority Data

Mar. 15, 2016 (DE) ..... 10 2016 003 134

(51) Int. Cl.
*H01B 11/00* (2006.01)
*H01B 7/02* (2006.01)
(Continued)

(52) U.S. Cl.
CPC ..... *H01B 11/005* (2013.01); *H01B 7/0216* (2013.01); *H01B 11/08* (2013.01); *H01B 3/30* (2013.01); *H01B 7/02* (2013.01)

(58) Field of Classification Search
CPC ..... H01B 11/20; H01B 7/046; H01B 7/295; H01B 11/1856; H01B 13/08; H01B 13/22;
(Continued)

(56) References Cited

U.S. PATENT DOCUMENTS 6,255,594 B1 * 7/2001 Hudson ..... H01B 7/295 174/121 A
6,403,887 B1 6/2002 Kebabjian et al.
8,981,216 B2 * 3/2015 Grant ..... H01B 11/06 174/113 R
(Continued)

FOREIGN PATENT DOCUMENTS

EP 0567757 B1 11/1993
GB 609558 A 10/1948
(Continued)

*Primary Examiner* — William H. Mayo, III
*Assistant Examiner* — Krystal Robinson
(74) *Attorney, Agent, or Firm* — DeLio, Peterson & Curcio, LLC; Robert Curcio

(57) ABSTRACT

A cable for transmitting electrical signals including an outer casing made of an electrically insulating material and at least N lines n with N≥2 and N€N which are arranged within the outer casing, wherein each line m has a total of M wires made of an electrically conductive material with M≥1 and M€N, wherein the wire m with m€[1, M], m€N, the line n with n E [1, N], n€N is surrounded by a dielectric having a predetermined value for the relative permittivity er(m,n)>1, wherein for each line n the value for the relative permittivity of the dielectrics (24. 26. 28. 30) of the wires (16, 18, 20, 22) of this line n is identical, except for deviations resulting from the manufacturing process, so that er(p·n)=er(p+q,n), where q€[1, M−p], q€Np € [1, M−1], p€N.

13 Claims, 8 Drawing Sheets

(51) Int. Cl.
*H01B 11/08* (2006.01)
*H01B 3/30* (2006.01)

(58) Field of Classification Search
CPC .. H01B 7/0216; H01B 7/0241; H01B 7/0291; H01B 7/2806; H01B 9/005; H01B 11/002; H01B 11/005; H01B 11/08; H01B 11/1091; H01B 11/1808; H01B 11/1834; H01B 11/1839; H01B 11/1895; H01B 11/203; H01B 13/141; H01B 3/30; H01B 3/308; H01B 3/441; H01B 7/1875; H01B 7/292; H01B 7/361
See application file for complete search history.

(56) References Cited

U.S. PATENT DOCUMENTS

| | | | | |
|---|---|---|---|---|
| 2003/0070831 | A1* | 4/2003 | Hudson | H01B 7/295 174/113 R |
| 2005/0056454 | A1 | 3/2005 | Clark | |
| 2008/0105449 | A1 | 5/2008 | Kenny | |
| 2008/0236867 | A1* | 10/2008 | Varkey | H01B 7/046 174/115 |
| 2010/0307790 | A1 | 12/2010 | Okano | |

FOREIGN PATENT DOCUMENTS

| | | | |
|---|---|---|---|
| GB | 792338 | A | 3/1958 |
| JP | H1125765 | A | 1/1999 |
| WO | 9844513 | A1 | 10/1998 |
| WO | 2010129680 | A1 | 11/2010 |

* cited by examiner

CABLE FOR TRANSMITTING ELECTRICAL SIGNALS

BACKGROUND OF THE INVENTION

1. Field of the Invention

The invention relates to a cable for transmitting electrical signals comprising an outer casing made of an electrically insulating material and at least N lines n with $N \geq 2$ and $N \in \mathbb{N}$ which are arranged within the outer casing, wherein each line m has a total of M wires made of an electrically conductive material with $M \geq 1$ and $M \in \mathbb{N}$, wherein the wire m with $m \in [1, M]$, $m \in \mathbb{N}$, the line n with $n \in [1, N]$, $n \in \mathbb{N}$ is surrounded by a dielectric having a predetermined value for the relative permittivity $\varepsilon_r(m,n) > 1$ wherein for each line n the value for the relative permittivity of the dielectrics (24, 26, 28, 30) of the wires (16, 18, 20, 22) of this line n is identical, except for deviations resulting from the manufacturing process, so that $\varepsilon_r(p,n) = \varepsilon_r(p+q,n)$, where $q \in [1, M-p]$, $q \in \mathbb{N}$, $p \in [1, M-1]$, $p \in \mathbb{N}$.

2. Description of Related Art

A cable for transmitting electrical signals contains wires made of a conductive material, which for the purpose of mutual electrical insulation are in each case surrounded by an electrical insulator. Electrical insulators have dielectric properties and have a decisive influence on the propagation or conductive properties of the cable for electrical signals, which are substantially electromagnetic waves. An important property of dielectric materials or of a dielectric is its permittivity $\varepsilon$.

The permittivity $\varepsilon$ (from the Latin permittere: to allow, transmit, admit), also referred to as "dielectric conductivity" or "dielectric function", states the permeability of a material to electrical fields. The vacuum is also assigned a permittivity, since electrical fields can also be formed or electromagnetic fields propagated in a vacuum.

The relative permittivity $\varepsilon_r$ of a medium, also referred to as the permittivity or dielectric constant, is the ratio of its permittivity $\varepsilon$ to that of the vacuum (electric field constant $\varepsilon_0$):

$$\varepsilon_r = \frac{\varepsilon}{\varepsilon_0}$$

It is a measure of the field-weakening effects of the dielectric polarisation of the medium and is closely related to the electrical susceptibility $\chi_e = \varepsilon_r - 1$. In the English-language literature and in semiconductor technology, the relative permittivity is also designated with $\kappa$ (kappa) or—for example as in the case of low-k dielectrics—with k. The earlier term "dielectric constant" is also commonly used as a synonym for the relative permittivity.

For the electromagnetic shielding of a cable for transmitting electrical signals, it is usual to surround the cable with a shielding casing made of an electrically conductive material. This reduces an unimpeded emission from the cable of electrical or electromagnetic signals which are transmitted via the cable and at the same time reduces a penetration of electromagnetic signals into the lines of the cable from outside. Where several electrical signals are transmitted via different lines of a cable, in addition to increasing the diameter and weight of the cable, the problem also arises that electrical signals crosstalk, in an undesired manner, from one line of the cable into a different line of the cable. In order to prevent this, it is known also to provide the individual lines of the cable with a shielding casing made of an electrically conductive material. However, this makes the cable expensive as well as inflexible when laying, since the cable as a whole becomes very rigid and certain bending radii may not be exceeded in order not to damage the shielding casing of the lines.

In order to reduce the crosstalk of electrical signals from one line into a different line within a cable, without an additional shielding casing needing to be present for each line in the cable, the so-called star quad cable has been suggested (Twisted/Star Quad (TQ); also referred to in the following as "star quad" for short). The star quad cable, like the STP cable (Shielded Twisted Pair) and the UTP cable (Unshielded Twisted Pair) is classed as one of the symmetrical copper cables. In the star quad cable, two lines each consisting of two wires in each case made of an electrically conductive material are combined to form a cable. Each wire is surrounded by a dielectric and the four wires are twisted with one another in a cruciform manner, wherein, viewed in the cross section of the star quad cable, opposite wires in each case form a wire pair, so that the star quad cable comprises two wire pairs or lines. The four wires which are twisted with one another are surrounded by a common protective sheath, which can comprise a braided or foil shield. This mechanical structure determines the technical transmission parameters such as the near-end and far-end crosstalk. This cable type is distinguished above all by its small diameter and the resulting small bending radius. In addition to the mechanical stabilization of the arrangement of the conductors or wires relative to one another, a further advantage of star quad stranding is the higher packing density compared with a pair stranding.

The star quad cable substantially corresponds to the UTP and STP cables and can be classified accordingly: unshielded star quad cables are referred to as Twisted Quad (UTQ).

In the star quad cable, a wire with a sheath made of insulating material arranged around it forms a conductor, and two wires or conductors in each case form a line. Two pairs of conductors or two lines are twisted with one another and then form two double wires twisted in a cruciform manner (a double wire corresponds to a line). Two conductors or wires arranged opposite one another in the cross section of the star quad cable form a pair, wherein an electrical signal is in each case transmitted on a pair. In other words, the four conductors or wires in the cross section of the star quad are arranged at the corners of a square, wherein the conductors or wires of a pair are arranged in diagonally opposite corners. The fact that the conductor pairs or wire pairs are arranged perpendicular to one another leads to a desirable suppression of crosstalk from one pair to the other pair, or only very slight crosstalk takes place from one pair to the other pair. The expression "conductor pairs or wire pairs arranged perpendicular to one another" means that, viewed in the cross section of the cable, a first straight line which runs through the centre point of the conductors or wires of a pair is oriented perpendicular to a second straight line which runs through the centre point of the conductors or wires of the other pair.

The publication US 2010/307790 A1 relates to a cable with at least one pair of core conductors which in each case consist of a conductor and a dielectric surrounding said conductor. The surrounding dielectric is hereby formed in two pieces with an inner dielectric and an outer dielectric.

The publication US 2010/307790 A1 addresses the problem that the dielectrics of the two conductors are supposed to be in different colours. According to US 2010/307790 A1 this is problematic because the introduction of different colour pigments into the respective dielectric results in different permittivities for the dielectrics. The core conductors are all identically structured and differ only in the hue of the outer dielectric. The publication US 2010/307790 A1 explicitly teaches that a different permittivity of the dielectrics of different core conductors is to be minimised. This is achieved in that the colour pigments, which create an undesired change in the permittivity, are only introduced into the thin outer dielectric in order to minimise differences in the permittivity. Differences in the permittivity of the dielectrics of core conductors of a pair of up to 0.05 should be accepted in order to realise desired colour selections.

The publication JP H11 25765 A addresses the problem of different signal runtimes on different twisted wire pairs if different lay lengths are formed for different wire pairs. Runtime differences between twisted wire pairs with different lay lengths are reduced in that, in a cable with several twisted wire pairs, the permittivity for the dielectric in a wire pair with the longest lay length is selected to be greater by a value of 0.1 or more in comparison with a wire pair with the shortest lay length. This is intended to improve the attenuation of the near-end crosstalk (crosstalk at the end of the cable at which the signal is fed in), since different lay lengths can be retained.

SUMMARY OF THE INVENTION

The invention is based on the problem of improving a cable of the aforementioned type in terms of the crosstalk between two lines.

According to the invention this problem is solved through a cable of the aforementioned type with the characterizing features of independent claims. Advantageous embodiments of the invention are described in the further dependent claims.

The above and other objects, which will be apparent to those skilled in the art, are achieved in the present invention which is directed to a cable for transmitting electrical signals with—an outer casing made of an electrically insulating material and at least N lines n with $N \geq 2$ and $N \in \mathbb{N}$ which are arranged within the outer casing, wherein each line n with $n \in [1, N]$ has a total of M wires made of an electrically conductive material with $M \geq 1$ and $M \in \mathbb{N}$, wherein the wire m with $m \in [1,M]$, $m \in \mathbb{N}$, the line n with $n \in [1, N]$, $n \in \mathbb{N}$ is surrounded by a dielectric with a predetermined value for the relative permittivity $\varepsilon_r(m,n)>1$, wherein for each line n the value for the relative permittivity of the dielectrics of the wires of this line n is identical, except for deviations resulting from the manufacturing process, so that $\varepsilon_r(p,n)=\varepsilon_r(p+q,n)$, where $q \in [1, M-p]$, $q \in \mathbb{N}$, $p \in [1, M-1]$, $p \in \mathbb{N}$, such that the following applies for at least two different lines n=j and n=(j+s): $\varepsilon_r(m,j)=\varepsilon_r(m,j+s)-k(s)$ with $m \in [1, M]$, $m \in \mathbb{N}$, $j \in [1, N-1]$, $j \in \mathbb{N}$, $s \in [1, N-j]$, $s \in \mathbb{N}$, where $k(s) \in \mathbb{R}$ and $k(s) \in [-2.0, -0{,}01]$ and $k(s) \in [0.01, 2.0]$, wherein the cable is a star quad cable with M=2 and N=2, in which the four wires of the two lines are twisted with one another in a cruciform manner.

The dielectric of the wires of at least one line is preferably made of the material polypropylene (PP) and the dielectric of the wires of at least one different line is made of the material polyethylene (PE). The dielectric of the wires of at least one line may be built up of a concentric layered structure of two or more dielectric materials with different values for the relative permittivity $\varepsilon_r$.

The case of the wires of at least one line, a space between the wires of this line and the outer casing facing the wires of this line is filled with a dielectric material which has a different value for the relative permittivity $\varepsilon_r$ than that of the dielectric surrounding the wires of this line.

A coating with an additional dielectric may be provided on an inner side of the outer casing which faces the wires of a line which has a different value for the relative permittivity $\varepsilon_r$ than that of the dielectric surrounding the wires of this line.

The additional dielectric is structured as a sequence of layers of dielectric materials, each case having a different value for the relative permittivity $\varepsilon_r$.

The dielectric of at least one wire may be arranged in a space between the wire and the outer casing such that, viewed in the cross section of the cable, this space is delimited from the adjacent wires in parabolic form.

The expression $k \in [-u, -w]$ and $k \in [w, u]$, are defined where w=0.01, 0.03, 0.1, 0.2, 0.3, 0.5, 0.7, 0.9, 1.0, 1.2, 1.4 or 1.6 and u=0.03, 0.1, 0.2, 0.3, 0.5, 0.7, 0.9, 1.0, 1.2, 1.4, 1.6 or 1.8 and $|w|<|u|$.

In addition, a shielding casing made of an electrically conductive material is provided within which the lines are arranged. The shielding casing is arranged radially outside of or within the outer casing. The shielding casing may be integrated in the outer casing.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
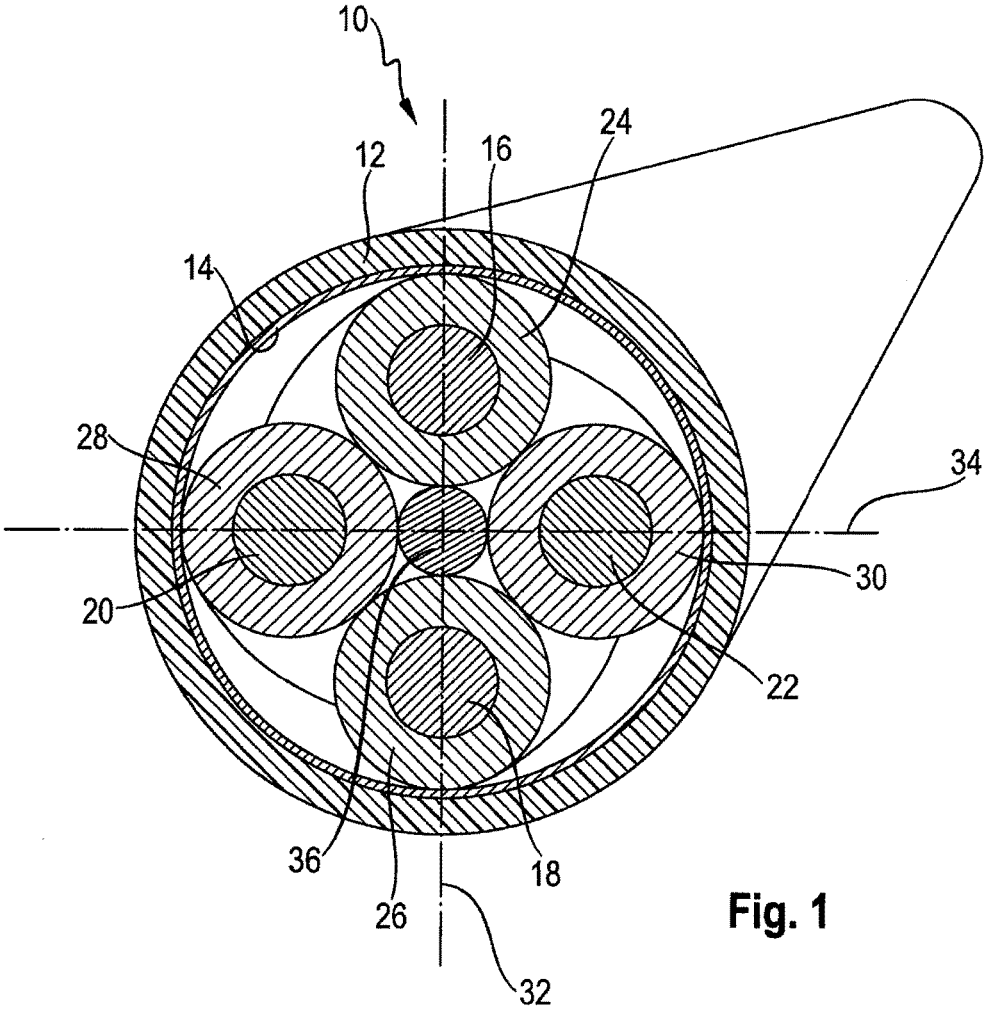
FIG. 1 shows a first preferred embodiment of a cable according to the invention in a perspective sectional view.

In describing the embodiment of the present invention, reference will be made herein to FIGS. 1-8 of the drawings in which like numerals refer to like features of the invention.

In a cable of the aforementioned type, according to the invention the following applies for at least two different lines: $\varepsilon_r(m,j)=\varepsilon_r(m,j+s)-k(s)$ with $m \in [1, M]$, $m \in \mathbb{N}$, $j \in [1, N-1]$, $j \in \mathbb{N}$, $s \in [1, N-j]$, $s \in \mathbb{N}$, where $k(s) \varepsilon \mathbb{R}$ and $k(s) \in$

[−2.0, −0.01] and k(s)∈[0.01, 2.0]. In other words, the dielectrics of the wires of one line have a value for the relative permittivity $\varepsilon_r$ of the dielectrics surrounding the respective wires differing by |k(s)| between 0.01 to 2.0 in comparison with the wires of a different line. This results in different propagation speeds for electrical signals on these lines with different dielectrics around the wires. The value for k(s) is for example different for different values for s (k(1)≠k(2) . . . ≠k(N−j)); however, alternatively the values for k(s) can also be identical for some or all values for s (k(1)=k(2)= . . . =k(N−j)). The values of k(s) can also be identical for several partial quantities of values for s in the range from 1 to (N−j), so that for example three or more identical values for k(s) are present within a cable (if N is greater than or equal to 4), wherein the values for k(s) are different for different partial quantities. In a cable. different lines may have a different number M of wires. In this case the value for M would be a function of n: M(n), wherein the cable (10) is a star quad cable with M=2 and N=2 in which the four wires (16, 18, 20, 22) of the two conductors are twisted with one another in a cruciform manner.

This has the advantage that, surprisingly, the different propagation speeds of the electrical signals in the two lines with different values for the permittivity of the dielectrics of the respective wires leads to a reduced crosstalk of signals from one line into the other line.

A different value for the relative permittivity $\varepsilon_r(m,n)$ of the dielectric of the wires of different lines with a value |k| of around 0.3 is achieved in a manner which is particularly simple and economical to manufacture in that the dielectric of the wires of at least one line is made of the material polypropylene (PP; $\varepsilon_r \approx 2.1$) and the dielectric of the wires of at least one different line is made of the material polyethylene (PE, $\varepsilon_r \approx 2.4$).

A, in total, differing value for the relative permittivity $\varepsilon_r$ of the dielectric of the wires of a line with specific adjustment of a value for k for the deviation of the value for the relative permittivity $\varepsilon_r$ of the dielectric of the wires of a different line is achieved in a simple manner in that the dielectric of the wires of at least one line is built up of a concentric layered structure of two or more dielectric materials with different values for the relative permittivity $\varepsilon_r$.

A particularly advantageous adjustment of the value for the relative permittivity $\varepsilon_r$ of the dielectric of the wires of a line with high efficiency is achieved in that, in the case of the wires of at least one line, a space between the wires of this line and the outer casing facing the wires of this line is filled with an additional dielectric material which has a different value for the relative permittivity $\varepsilon_r$ than that of the dielectric surrounding the wires of this line. The dielectric used for filling is thereby located in the region of high field strength densities and is therefore particularly effective.

An alternative possibility for changing the relative permittivity $\varepsilon_r$ of the wires of individual lines, without needing to change the mechanical structure of the individual wires, is achieved in that a coating with an additional dielectric is provided on an inner side of the outer casing which faces the wires of a line which has a different value for the relative permittivity $\varepsilon_r$ than that of the dielectric surrounding the wires of this line.

A particularly pronounced influencing of the resulting relative permittivity $\varepsilon_r$ for individual wires is achieved in that the additional dielectric is structured as a sequence of layers of dielectric materials, in each case having a different value for the relative permittivity $\varepsilon_r$.

A high efficiency of the dielectric is achieved in that the dielectric of at least one wire is arranged in a space between the wire and the outer casing such that, viewed in the cross section of the cable, this space is delimited from the adjacent wires in parabolic form. As a result, the dielectric fills a space with high field line density.

The following is preferred for possible value ranges of k(s): k(s)∈[−u, −w] and k(s)∈[w, u], where w=0.01, 0.03, 0.1, 0.2, 0.3, 0.5, 0.7, 0.9, 1.0, 1.2, 1.4 or 1.6 and u=0.1, 0.2, 0.3, 0.5, 0.7, 0.9, 1.0, 1.2, 1.4, 1.6 or 1.8 and |w|<|u|. For example, 0.01<k(s)<1.0; 0.03<k(s)<0.3 or 0.1<k(s)<0.2.

An additional electromagnetic shielding is achieved in that, in addition, a shielding casing made of an electrically conductive material is provided within which the lines are arranged. This shielding casing is for example arranged radially outside of or within the outer casing or is integrated in the outer casing.

The invention is explained in more detail in the following with references to the drawings.

For the purpose of signal transmission in multi-conductor cables or cables with several wires, in order to achieve fast data transmission, signal transmission with differential pairs of lines or differential conductor pairs is preferably used. A typical cable used for such an application is the star quad cable.

Generally, a cable used for electrical signal transmission has a tubular outer casing made of an electrically insulating material. A shielding casing made of an electrically conductive material is also for example provided, wherein this is surrounded coaxially by the outer casing. Alternatively, the shielding casing is integrated in the outer casing. N lines with N≥2 and N∈ℕ are arranged radially within the shielding casing, wherein each line n with n∈[1, N] comprises a total of M wires made of an electrically conductive material with M≥1 and M∈ℕ. The wire m with m∈[1, M], m∈ℕ of the line n with n∈[1, N], n∈ℕ is surrounded by a dielectric with a predetermined value for the relative permittivity $\varepsilon_r(m,n)>1$. It is hereby preferable if the dielectrics of the different wires are produced in different colours, so that it is possible to clearly identify the wires at each end of the cable. The M wires of a line n are thereby in each case surrounded by a dielectric, wherein all dielectrics of the M wires of a line n should have a substantially identical value for the relative permittivity $\varepsilon_r(m,n)$ with m=1, . . . M. However, as a result of deviations resulting from the manufacturing process and also as a result of the colouring, slightly different values result for the values for the relative permittivity $\varepsilon_r(m,n)$ of the dielectrics of the M wires of a line. These deviations usually lie within the region of 5/1000 and, while actually undesirable, are unavoidable.

In other words, for each line n the value for the relative permittivity $\varepsilon_r$ of the dielectrics of the M wires of this line n is identical except for deviations resulting from the manufacturing process, so that $\varepsilon_r(p,n)=\varepsilon_r(p+q,n)$, where p∈[1, M−1], p∈ℕ and q∈[1, M−p], q∈ℕ. In other words, the running index p runs from 1 to (M−1) and is a whole number greater than zero and the running index q runs from 1 to (M−p) and is a whole number greater than zero. This means that, in each case, for each line n with n=1 to N:

$$n = 1:\ \varepsilon_r(1, 1) = \varepsilon_r(2, 1) = \ldots = \varepsilon_r(M-1, 1) = \varepsilon_r(M, 1)$$

$$n = 2:\ \varepsilon_r(1, 2) = \varepsilon_r(2, 2) = \ldots = \varepsilon_r(M-1, 2) = \varepsilon_r(M, 2)$$

$$\vdots$$

$$n = N-1:\ \varepsilon_r(1, N-1) = \varepsilon_r(2, N-1) = \ldots = \varepsilon_r(M-1, N-1) = \varepsilon_r(M, N-1)$$

$$n = N:\ \varepsilon_r(1, N) = \varepsilon_r(2, N) = \ldots = \varepsilon_r(M-1, N) = \varepsilon_r(M, N)$$

According to the invention, the value for the relative permittivity $\varepsilon_r$ of the dielectrics of the total of M wires of a line j differs by a value k(s) from a value for the relative permittivity $\varepsilon_r$ of the dielectrics of the M wires of at least one different line (j+s), for example the line (j+1). For at least two different lines, the following thereby applies: $\varepsilon_r(m,j)=\varepsilon_r(m,j+s)-k(s)$ with $m\in[1, M]$, $m\in\mathbb{N}$, $j\in[1,N-1]$, $j\in\mathbb{N}$, $s\in[1, N-j]$, $s\in\mathbb{N}$, where $k(s)\in\mathbb{R}$ and $k(s)\in[-2.0, -0.01]$ and $k(s)\in[0.01,2.0]$, or the index m for the wire runs from 1 to M and is a whole number greater than zero, the index j for the line j runs from 1 to (N−1) and is a whole number greater than zero, the index s for the line (j+s) runs from 1 to (N−j) and is a whole number greater than zero. Written out, this means that, for example for the lines 1 and 2 (j=1; s=1) for the M wires with m=1 to M:

$$m = 1:\ \varepsilon_r(1, 1) = \varepsilon_r(1, 2) - k(1)$$

$$m = 2:\ \varepsilon_r(2, 1) = \varepsilon_r(2, 2) - k(1)$$

$$\vdots$$

$$m = M-1:\ \varepsilon_r(M-1, 1) = \varepsilon_r(M-1, 2) - k(1)$$

$$m = M:\ \varepsilon_r(M, 1) = \varepsilon_r(M, 2) - k(1)$$

The value k(1) is hereby a number the amount of which |k(1)| is greater than the aforementioned undesired deviation of for example 5/1000 between the values of relative permittivities $\varepsilon_r$ which should be substantially identical. At the same time, the value of k(s) for two different lines (different value for s) can be different or identical. Preferred values for |k(s)| are for example 0.01, 0.03, 0.1, 0.2, 0.3, 0.5, 0.7, 0.9, 1.0, 1.2, 1.4, 1.6, 1.8, 2.0.

FIG. 1 shows an exemplary embodiment of a cable 10 according to the invention with N=2 and M=2 in the form of a star quad arrangement, wherein the four wires of the two lines are twisted with one another in a cruciform manner. The cable 10 has an outer casing 12 made of an electrically insulating material, a shielding casing 14 made of an electrical conductive material as well as a first wire 16, made of an electrically conductive material, of a first line (m=1, n=1), a second wire 18, made of an electrically conductive material, of the first line (m=2, n=1), a first wire 20, made of an electrically conductive material, of a second line (m=1, n=2) and a second wire 22, made of an electrically conductive material, of the second line (m=2, n=2). The first wire 16 (m=1) of the first line (n=1) is surrounded by a first dielectric 24 with a relative permittivity $\varepsilon_r(1,1)$, wherein here and in the following the numbers in brackets following the term "$\varepsilon_r$" represent indices, in this case the indices m and n. The second wire 18 (m=2) of the first line (n=1) is encased by a second dielectric 26 with a relative permittivity $\varepsilon_r(2,1)$. The first wire 20 (m=1) of the second line (n=2) is encased by a third dielectric 28 with a relative permittivity $\varepsilon_r(1,2)$. The second wire 22 (m=2) of the second line (n=2) is encased by a fourth dielectric 30 with a relative permittivity $\varepsilon_r(2,2)$.

The wires 16, 18 also form a first pair of lines or the first line and the wires 20, 22 form a second pair of lines or the second line.

Viewed in the cross section of the cable, a first straight line 32 runs through the center point of the wires 16 and 18 of the first line and a second straight line 34 runs through center points of the wires 20, 22 of the second line. The two straight lines 32, 34 run perpendicular to one another at each point in a sectional plane parallel to the representation or the drawing plane in FIG. 1.

Each wire 16, 18, 20, 22 forms a conductor with the associated dielectric 24, 26, 28, 30. The conductors 16/24, 18/26, 20/28, 22/30 are twisted or stranded with one another in an axial direction in a cruciform manner such that the known star quad arrangement results. The conductors 16/24, 18/26, 20/28, 22/30 are twisted with one another around a central core 36.

For this example of the star quad cable (M=2, N=2), the above equations for the relative permittivity $\varepsilon_r(m,n)$ of the dielectrics 24, 26, 28, 30 of the wires 16, 18, 20, 22 with m=1, 2 and n=1, 2 and j=1 and s=1 are as follows:

$$n=1:\varepsilon_r(1,1)=\varepsilon_r(2,1)$$

$$n=2:\varepsilon_r(1,2)=\varepsilon_r(2,2)$$

and $$m=1:\varepsilon_r(1,1)=\varepsilon_r(1,2)-k(1)$$

$$m=2:\varepsilon_r(2,1)=\varepsilon_r(2,2)-k(1)$$

Figure 2:
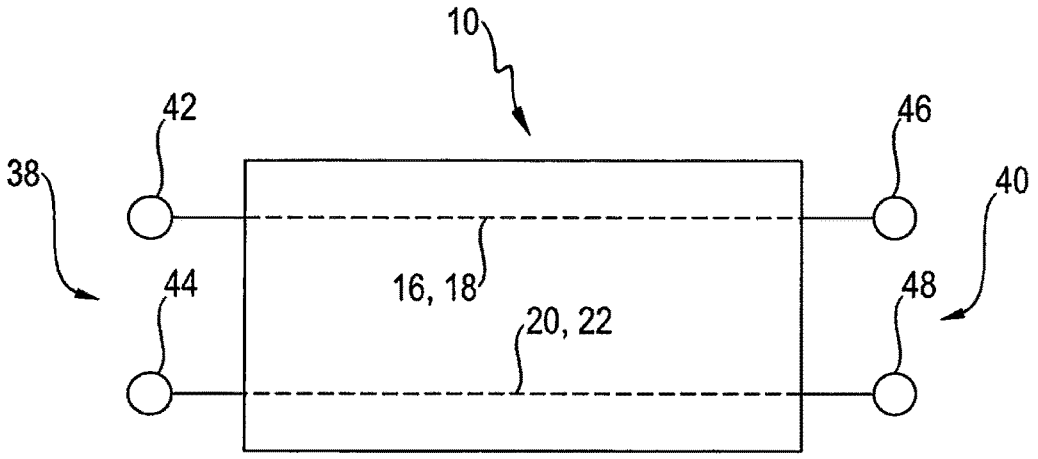
FIG. 2 shows a cable according to the invention cable as a four-port.

FIG. 2 shows the star quad cable as a 4-port with a first end 38 and a second end 40. The first line with the wires 16, 18 and the dielectrics 24, 26 (FIG. 1) form a first differential port 42 at the first end 38 and a third differential port 46 at the second end. The second line with the wires 20, 22 and the dielectrics 28, 30 (FIG. 1) forms a second differential port 44 at the first end 38 and a fourth differential port 48 at the second end.

If a wave is now fed in at the first end 38 at the first port 42 of the first line with the wires 16, 18, then a part of the wave is measurable at the second, third and fourth port 44, 46, 48. The wave component measurable at the third port 46 is a transmission. The wave component measurable at the second port 44 is a so-called "crosstalk" at the near end 38 "NEXT" (Near End Crosstalk), i.e. this is a crosstalk from the first line with the wires 16, 18 into the second line with the wires 20, 22 which is reflected back to the first end 38. The wave component measurable at the fourth port is a so-called "crosstalk" at the far end 40 "FEXT" (Far End Crosstalk), i.e. this is a crosstalk from the first line with the wires 16, 18 into the second line with the wires 20, 22 which is transmitted to the second end 40. This "FEXT" is an undesired effect which is to be prevented. Accordingly, a reduction in this wave component "FEXT" improves the transmission properties of the cable 10 at the second end 40.

Figure 3:
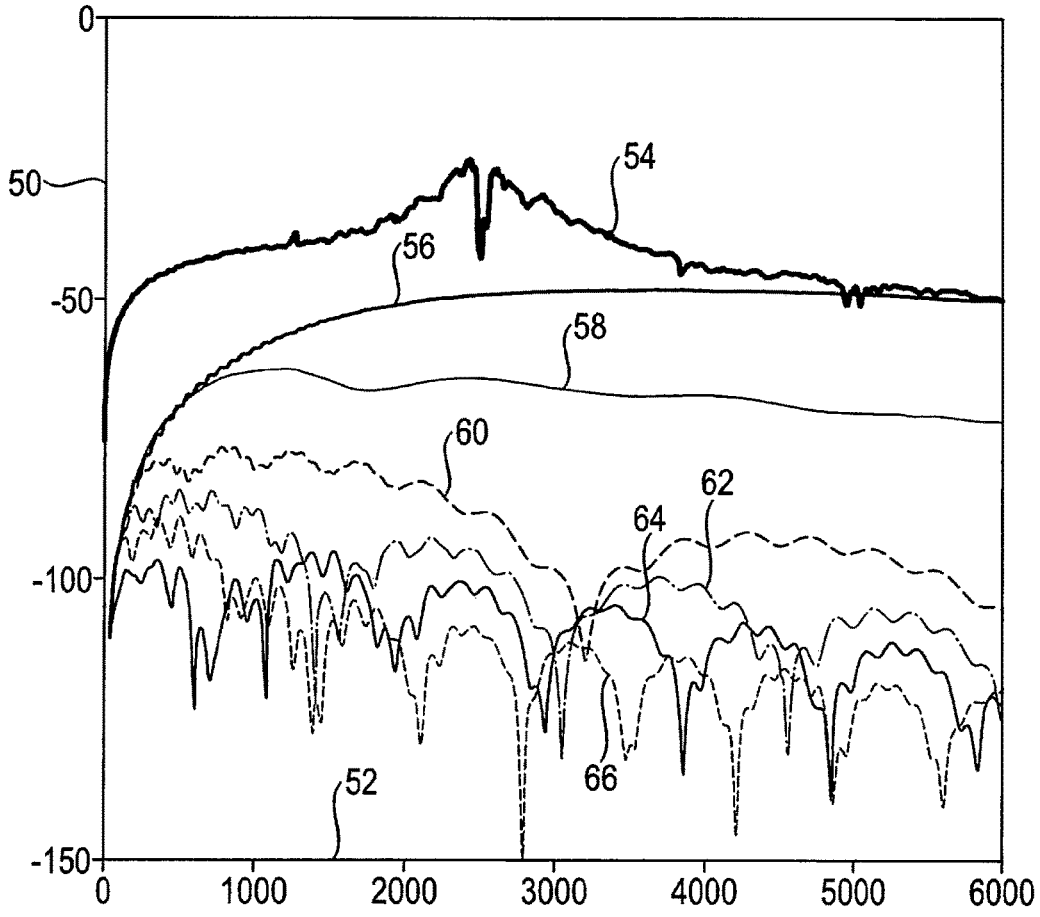
FIG. 3 shows a graphic representation of the arithmetical determination of the crosstalk of an electrical signal from one line into another line with different values for k(s) on the basis of a cable model.

In order to test whether the difference in the relative permittivities $\varepsilon_r(m,n)$ results in an improvement in terms of the FEXT, this FEXT was calculated for a star quad cable designed according to the invention, as described above, using a cable model. The result is shown in FIG. 3. In FIG. 3, 50 identifies a vertical axis on which the FEXT is entered in [dB]. 52 identifies a horizontal axis on which a frequency f of the input signal at the first port 42 (FIG. 2) is entered in [MHz].

A first graph 54 shows the curve of the FEXT over the frequency in a conventional star quad cable, as actually measured.

A second graph 56 shows the curve of the FEXT over the frequency in a conventional star quad cable, as calculated from the cable model with k(1)=0. In the calculation by means of the cable model, the following values were assumed for the relative permittivities $\varepsilon_r(m,n)$ of the dielectrics 24, 26, 28, 30:

$\varepsilon_r(1,1)=2.235$ $\varepsilon_r(2,1)=2.240$ $\varepsilon_r(1,2)=2.235$ $\varepsilon_r(2,2)=2.240$ For the relative permittivities $\varepsilon_r(m,n)$ of the dielectrics 24, 26, 28, 30, a scattering of the values due to inaccuracies in manufacture and influences resulting from the colouring of the dielectrics with a deviation of 5/1000 is assumed. The curve of the second graph 56 following close to the first graph 54 confirms that that the cable model is serviceable.

A third graph 58 shows the curve of the FEXT over the frequency in a star quad cable according to the invention, as calculated from the cable model with k(1)=0.1. In the calculation by means of the cable model, the following values were assumed for the relative permittivity $\varepsilon_r(m,n)$ of the dielectrics 24, 26, 28, 30:

$\varepsilon_r(1,1)=2.235$ $\varepsilon_r(2,1)=2.240$ $\varepsilon_r(1,2)=2.135$ $\varepsilon_r(2,2)=2.140$ A fourth graph 60 shows the curve of the FEXT over the frequency in a star quad cable according to the invention, as calculated from the cable model with k(1)=0.3. In the calculation by means of the cable model, the following values were assumed for the relative permittivity $\varepsilon_r(m,n)$ of the dielectrics 24, 26, 28, 30:

$\varepsilon_r(1,1)=2.235$ $\varepsilon_r(2,1)=2.240$ $\varepsilon_r(1,2)=1.935$ $\varepsilon_r(2,2)=1.940$ A fifth graph 62 shows the curve of the FEXT over the frequency in a star quad cable according to the invention, as calculated from the cable model with k(1)=0.5. In the calculation by means of the cable model, the following values were assumed for the relative permittivity $\varepsilon_r(m,n)$ of the dielectrics 24, 26, 28, 30:

$\varepsilon_r(1,1)=2.235$ $\varepsilon_r(2,1)=2.240$ $\varepsilon_r(1,2)=1.735$ $\varepsilon_r(2,2)=1.740$ A sixth graph 64 shows the curve of the FEXT over the frequency in a star quad cable according to the invention, as calculated from the cable model with k(1)=0.7. In the calculation by means of the cable model, the following values were assumed for the relative permittivity $\varepsilon_r(m,n)$ of the dielectrics 24, 26, 28, 30:

$\varepsilon_r(1,1)=2.235$ $\varepsilon_r(2,1)=2.240$ $\varepsilon_r(1,2)=1.535$ $\varepsilon_r(2,2)=1.540$ A seventh graph 66 shows the curve of the FEXT over the frequency in a star quad cable according to the invention, as calculated from the cable model with k(1)=0.9. In the calculation by means of the cable model, the following values were assumed for the relative permittivity $\varepsilon_r(m,n)$ of the dielectrics 24, 26, 28, 30:

$\varepsilon_r(1,1)=2.235$ $\varepsilon_r(2,1)=2.240$ $\varepsilon_r(1,2)=1.335$ $\varepsilon_r(2,2)=1.340$ The more the nominal value for the relative permittivity $\varepsilon_r(m,n)$ differs between the two lines, the lower the crosstalk (FEXT) in the other line. Thus, the transmission properties of the cable 10 can be improved, in a surprising manner, through a difference k(s) in the relative permittivity $\varepsilon_r(m,n)$ of the dielectrics 24, 26, 28, 30, without this requiring an additional shielding casing for each individual pair of lines 16, 18 and 20, 22.

Figure 4:
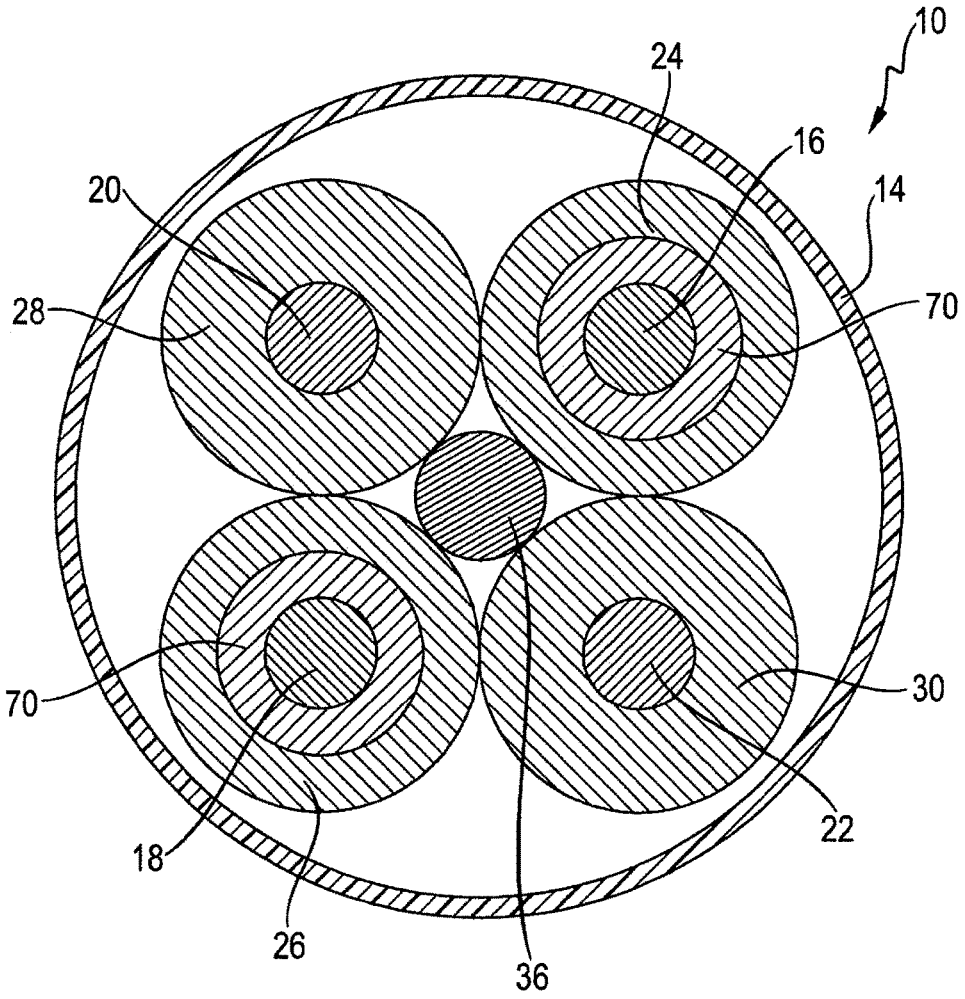
FIG. 4 shows a second preferred embodiment of a cable according to the invention in a sectional view.

FIG. 4 shows a second preferred embodiment of a cable 10 according to the invention, wherein parts with the same function are identified with the same reference symbols as in FIG. 1, so that regarding their explanation reference is made to the above description relating to FIG. 1. In FIG. 4, different hatchings or fillings of the dielectrics 24, 26, 28, 30 show different values for the relative permittivity $\varepsilon_r(m,n)$. An outer casing is not represented in FIG. 4. Thus, it can be seen that the dielectrics 24, 26, 28, 30 are fundamentally produced with the same value for the relative permittivity $\varepsilon_r(m,n)$; however, the dielectrics 24 and 26 are structured in two parts, in each case with two materials with different relative permittivity $\varepsilon_r$. A first material with the same relative permittivity $\varepsilon_r$ as the dielectrics 28 and 30 encases the wires 16, 18; however, in addition a second material 70 with a different value for the relative permittivity $\varepsilon_r$ is arranged radially between the wires 16, 18 and the first material, so that the dielectrics 24, 26 effectively have a different value for the relative permittivity $\varepsilon_r$ than the dielectrics 28 and 30. The first and second dielectric materials are arranged concentrically to one another and to the respective wires 16, 18.

Figure 5:
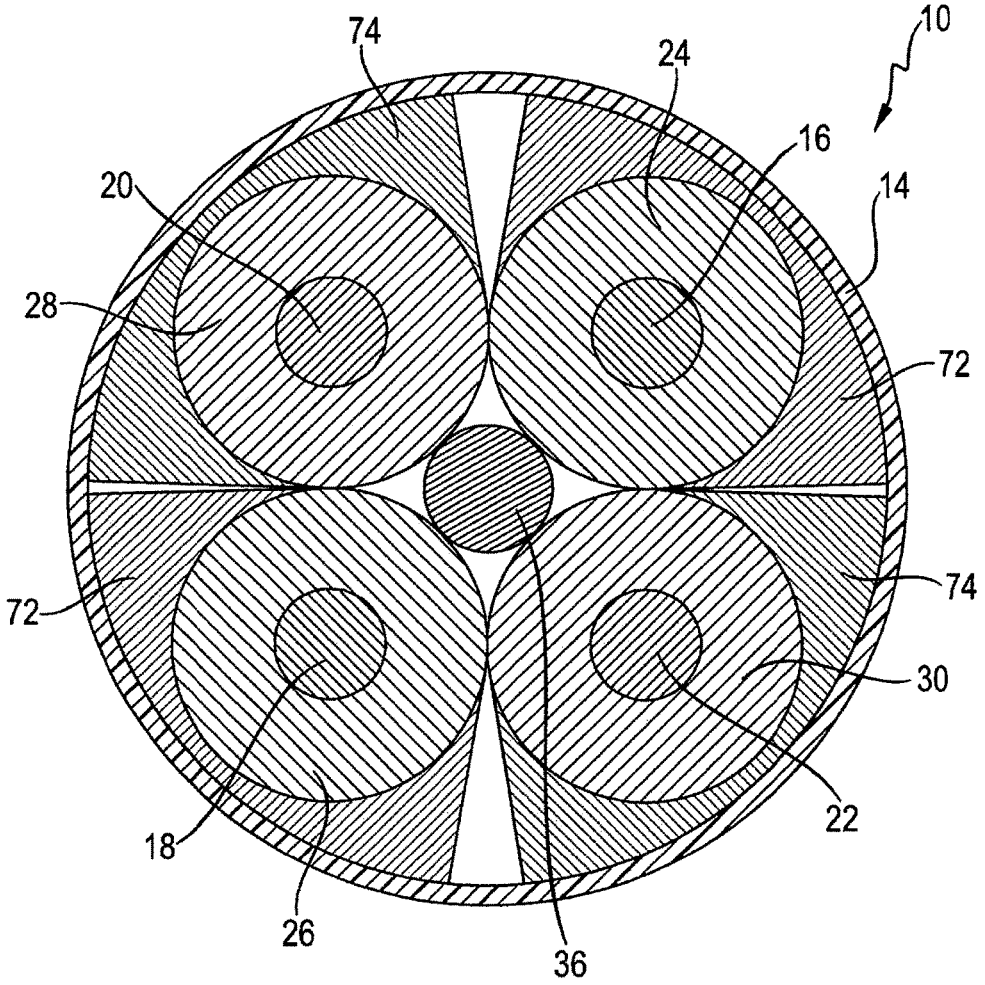
FIG. 5 shows a third preferred embodiment of a cable according to the invention in a sectional view.

FIG. 5 shows a third preferred embodiment of a cable 10 according to the invention, wherein parts with the same function are identified with the same reference symbols as in FIGS. 1 and 4, so that regarding their explanation reference is made to the above description relating to FIGS. 1 and 4. In FIG. 5, different hatchings or fillings show different values for the relative permittivity $\varepsilon_r$. An outer casing is not represented in FIG. 5. In this embodiment, the wires 16, 18, 20, 22 are surrounded by identical dielectrics, so that their relative permittivity $\varepsilon_r$ is substantially identical. However, in addition, respective spaces between the lines 16/24, 18/26, 20/28 and 22/30 and the shielding casing 14 are filled with a further first dielectric 72 and a further second dielectric 74 which in each case have values for the relative permittivity $\varepsilon_r$ which differ from the dielectrics 24, 26, 28, 30 and also from one another. In this way, the effective values for the relative permittivity $\varepsilon_r(m,n)$ of the line with the wires 16, 18 differ from the value for the relative permittivity $\varepsilon_r(m,n)$ of the line with the wires 20, 22. The filling with the further first and second dielectrics 72 and 74 is such that, viewed in cross section, these fill a region delimited, in parabolic form, by the adjacent lines 16/24, 18/26, 20/28 and 22/30. In this way, the further dielectrics 72 and 74 are located precisely in regions with increased field line density and thus have a great effect.

Figure 6:
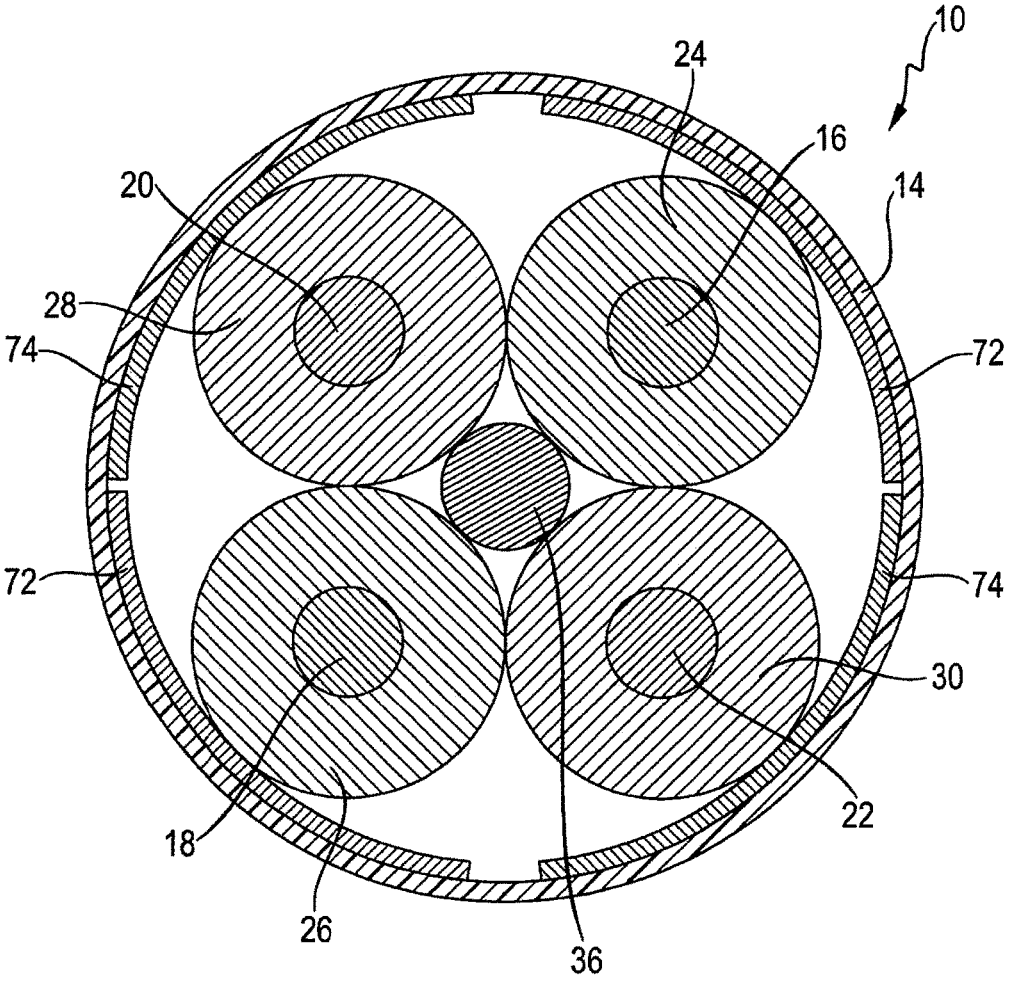
FIG. 6 shows a fourth preferred embodiment of a cable according to the invention in a sectional view.

FIG. 6 shows a fourth preferred embodiment of a cable 10 according to the invention, wherein parts with the same function are identified with the same reference symbols as in FIGS. 1, 4 and 5, so that regarding their explanation reference is made to the above description relating to FIGS. 1, 4 and 5. In FIG. 6, different hatchings or fillings show different values for the relative permittivity $\varepsilon_r$. An outer casing is not represented in FIG. 6. In this embodiment, the wires 16, 18, 20, 22 are surrounded by identical dielectrics 24, 26, 28, 30, so that their relative permittivity $\varepsilon_r$ is substantially identical. The additional dielectrics 72 and 74 are arranged on the inner side of the shielding casing 14, in each case such that these are each located between a dielectric 24, 26, 28, 30 of the wires 16, 18, 20, 22 and the shielding casing 14. In this way, the effective values for the relative permittivity $\varepsilon_r(m,n)$ of the line with the wires 16, 18 differ from the value for the relative permittivity $\varepsilon_r(m,n)$ of the line with the wires 20, 22.

Figure 7:
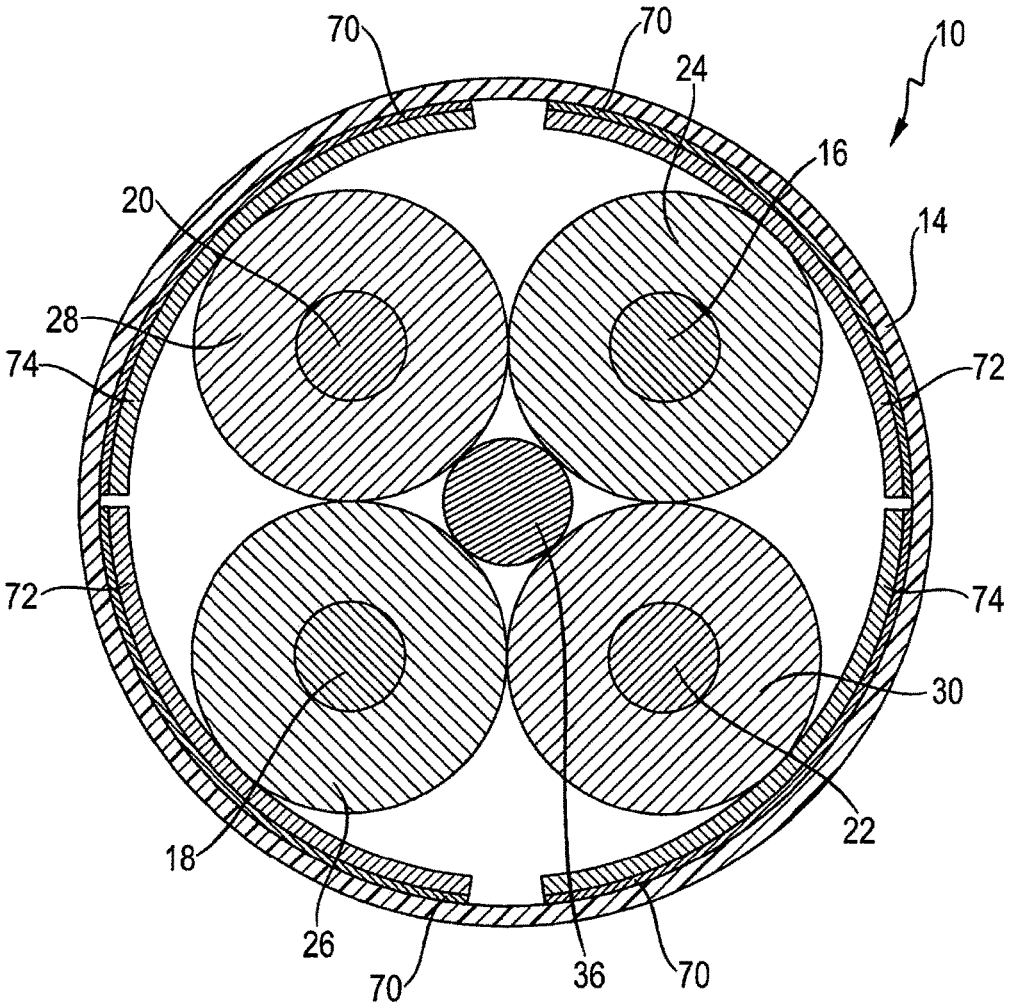
FIG. 7 shows a fifth preferred embodiment of a cable according to the invention in a sectional view.

FIG. 7 shows a fifth preferred embodiment of a cable 10 according to the invention, wherein parts with the same function are identified with the same reference symbols as in FIGS. 1, 4, 5 and 6, so that regarding their explanation reference is made to the above description relating to FIGS. 1, 4, 5 and 6. In FIG. 7, different hatchings or fillings show different values for the relative permittivity $\varepsilon_r$. An outer casing is not represented in FIG. 7. In this embodiment, the wires 16, 18, 20, 22 are surrounded by identical dielectrics 24, 26, 28, 30, so that their relative permittivity $\varepsilon_r$ is substantially identical. The additional dielectrics 72 and 74 are arranged on the inner side of the shielding casing 14, in each case such that these are each located between a dielectric 24, 26, 28, 30 of the wires 16, 18, 20, 22 and the shielding casing 14. In contrast to the fourth embodiment shown in FIG. 6, the additional dielectrics 72 and 74 are built up in layers with the further dielectric 70. In this way, the effective values for the relative permittivity $\varepsilon_r(m,n)$ of the line with the wires 16, 18 differ from the value for the relative permittivity $\varepsilon_r(m,n)$ of the line with the wires 20, 22.

Figure 8:
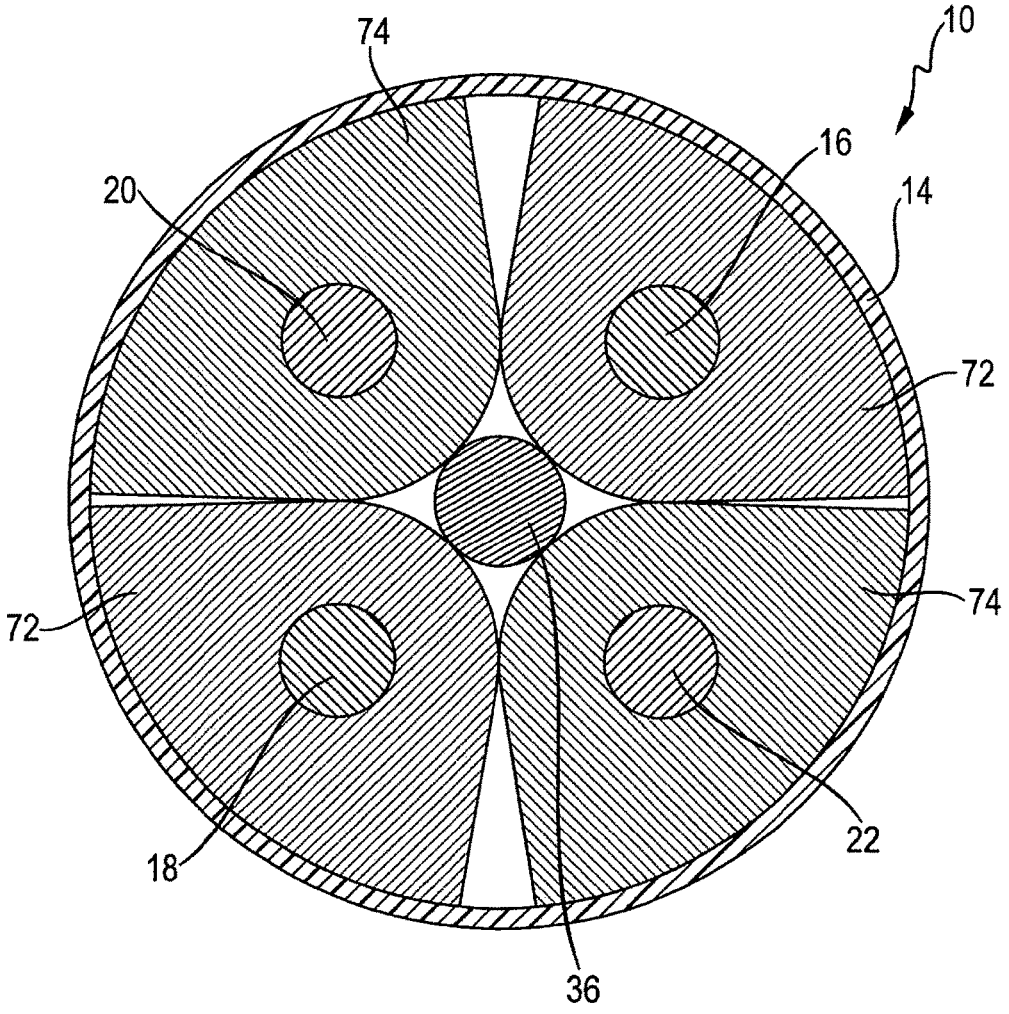
FIG. 8 shows a sixth preferred embodiment of a cable according to the invention in a sectional view.

FIG. 8 shows a sixth preferred embodiment of a cable 10 according to the invention, wherein parts with the same function are identified with the same reference symbols as in FIGS. 1, 4, 5, 6 and 7, so that regarding their explanation reference is made to the above description relating to FIGS. 1, 4, 5, 6 and 7. In FIG. 8, different hatchings or fillings show different values for the relative permittivity $\varepsilon_r$. An outer casing is not represented in FIG. 8. In this embodiment, the wires 16, 18, 20, 22 are exclusively surrounded by the further dielectric 72 to 74 and the dielectric 72, 74 in each case extends, analogously to the second embodiment according to FIG. 4, from the wires 16, 18, 20, 22 up to the shielding casing 14 and thereby in each case fills a space delimited, in cross section, in parabolic form. In this way, the effective values for the relative permittivity $\varepsilon_r(m,n)$ of the line with the wires 16, 18 differ from the value for the relative permittivity $\varepsilon_r(m,n)$ of the line with the wires 20, 22, and the dielectrics 72, 74 fill precisely that space within the shielding casing 14 in which the highest field line density occurs.

The invention covers all combinations of the features in each case disclosed in the description, the features in each case claimed in the claims and the features in each case illustrated in the figures of the drawing, insofar as these are technically expedient.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A cable for transmitting electrical signals with an outer casing made of an electrically insulating material and at least N lines n with $N \geq 2$ and $N \in \mathbb{N}$ which are arranged within the outer casing, wherein each line n with $n \in [1, N]$ has a total of M wires made of an electrically conductive material with $M \geq 1$ and $M \in \mathbb{N}$, wherein the wire m with $m \in [1, M]$, $m \in \mathbb{N}$, of the line n with $n \in [1, N]$, $n \in \mathbb{N}$ is surrounded by a dielectric with a predetermined value for the relative permittivity $\varepsilon_r(m,n)>1$, wherein for each line n the value for the relative permittivity of the dielectrics of the wires of this line n is identical, except for deviations resulting from the manufacturing process, so that $\varepsilon_r(p,n)=\varepsilon_r(p+q,n)$, where $q \varepsilon [1, M-p]$, $q \in \mathbb{N}$, $p \varepsilon [1, M-1]$, $p \in \mathbb{N}$, such that the following applies for at least two different lines n=j and n=(j+s): $\varepsilon_r(m,j)=\varepsilon_r(m,j+s)-k(s)$ with $m \varepsilon [1, M]$, $m \in \mathbb{N}$, $j \varepsilon [1, N-1]$, $j \in \mathbb{N}$, $s \in [1, N-j]$, $s \in \mathbb{N}$, where $k(s) \varepsilon \mathbb{R}$ and $k(s) \in [-2.0, -0.01]$ and $k(s) \in [0.01, 2.0]$, wherein the cable is a star quad cable with M=2 and N=2, in which the four wires of the two lines are twisted with one another in a cruciform manner.

2. The cable of claim 1, wherein the dielectric of the wires of at least one line is made of the material polypropylene (PP) and the dielectric of the wires of at least one different line is made of the material polyethylene (PE).

3. The cable of claim 2, wherein the dielectric of the wires of at least one line is built up of a concentric layered structure of two or more dielectric materials with different values for the relative permittivity $\varepsilon_r$.

4. The cable of claim 3, wherein $k \in [-u, -w]$ and $k \in [w, u]$, are defined where w=0.01, 0.03, 0.1, 0.2, 0.3, 0.5, 0.7, 0.9, 1.0, 1.2, 1.4 or 1.6 and u=0.03, 0.1, 0.2, 0.3, 0.5, 0.7, 0.9, 1.0, 1.2, 1.4, 1.6 or 1.8 and $|w|<|u|$.

5. The cable of claim 1, wherein the dielectric of the wires of at least one line is built up of a concentric layered structure of two or more dielectric materials with different values for the relative permittivity $\varepsilon_r$.

6. The cable of claim 1, wherein in the case of the wires of at least one line, a space between the wires of this line and the outer casing facing the wires of this line is filled with a dielectric material which has a different value for the relative permittivity $\varepsilon_r$ than that of the dielectric surrounding the wires of this line.

7. The cable of claim 1, wherein a coating with an additional dielectric is provided on an inner side of the outer casing which faces the wires of a line which has a different value for the relative permittivity $\varepsilon_r$ than that of the dielectric surrounding the wires of this line.

8. The cable of claim 7, wherein the additional dielectric is structured as a sequence of layers of dielectric materials, each case having a different value for the relative permittivity $\varepsilon_r$.

9. The cable of claim 1, wherein the dielectric of at least one wire is arranged in a space between the wire and the outer casing such that, viewed in the cross section of the cable, this space is delimited from the adjacent wires in parabolic form.

10. The cable of claim 1, wherein $k \in [-u, -w]$ and $k \in [w, u]$, are defined where w=0.01, 0.03, 0.1, 0.2, 0.3, 0.5, 0.7, 0.9, 1.0, 1.2, 1.4 or 1.6 and u=0.03, 0.1, 0.2, 0.3, 0.5, 0.7, 0.9, 1.0, 1.2, 1.4, 1.6 or 1.8 and $|w|<|u|$.

11. The cable of claim 1, wherein in addition, a shielding casing made of an electrically conductive material is provided within which the lines are arranged.

12. The cable of claim 11, wherein the shielding casing is arranged radially outside of or within the outer casing.

13. The cable of claim 11, wherein the shielding casing is integrated in the outer casing.

* * * * *